US005483912A

United States Patent [19]

Thomas

[11] Patent Number: 5,483,912

[45] Date of Patent: Jan. 16, 1996

[54] SMALL CRAFT CARRIER

[76] Inventor: Wayne Thomas, 6 White Dr., Neptune, N.J. 07753

[21] Appl. No.: 254,705

[22] Filed: Jun. 6, 1994

[51] Int. Cl.[6] ..... B63B 23/06

[52] U.S. Cl. ..... 114/259; 114/366

[58] Field of Search ..... 405/1–3; 114/258–260, 114/365, 366, 362, 375, 368, 230, 376

[56] References Cited

U.S. PATENT DOCUMENTS

| | | | |
|---|---|---|---|
| 2,465,118 | 3/1949 | Platt | 114/373 |
| 2,809,496 | 10/1957 | Geil | 405/2 |
| 4,864,951 | 9/1989 | Koepp, Jr. | 114/366 |
| 4,964,358 | 10/1990 | Sandrow | 114/365 |
| 5,193,479 | 3/1993 | Bielefeld | 114/259 |

FOREIGN PATENT DOCUMENTS

| | | | |
|---|---|---|---|
| 0026187 | 2/1987 | Japan | 114/259 |

*Primary Examiner*—Edwin L. Swinehart
*Attorney, Agent, or Firm*—David Edwards

[57] ABSTRACT

A small craft carrying device includes, a platform having two ends where one end is attached to the stern of a mother boat above the water line, a cradle attached to the other end of the platform in pivotal relationship so that the cradle can tilt towards and away from the mother boat, sling for attaching to the small craft, and power device for attaching to the sling for pulling the small craft onto the cradle and securing the small craft to the mother boat.

12 Claims, 7 Drawing Sheets

SMALL CRAFT CARRIER

FIELD OF INVENTION

This invention relates to a carrying device for small crafts. More particularly, this invention relates to a carrying device attached to a boat which permits the raising, storing, and lowering of a small craft such as a dinghy or jet ski into the water.

BACKGROUND OF THE INVENTION

Prior to the present invention, small crafts, such as dinghy or jet skis, had to be lifted by a hoisting device such as a crane or boom onto the side or deck of the mother boat for storage thereof. This was usually accomplished by a crane or hoisting mechanism that required several people to handle either manually or using a power winch. These types of lifting devices are costly and complex in design and require substantial reinforcement of the mother boat in order to make the deck strong enough to handle extreme loads required by the lifting crane. The L type cranes, the standard crane used by most small boaters, also are not suitable for lifting and storing small crafts onto yachts, for example less than 40 feet boats.

U.S. Pat. No. 4,878,450 sets forth an approach for trying to solve the problem by providing a boat-lifting device that is suitable for small vessels, is attached to the rear of the boat, and has a cradle that is vertically lowered to water level for transversely attaching a small dinghy thereto and raising the cradle vertically out of the water for storage.

SUMMARY OF THE INVENTION

The present invention is directed to a small craft carrying device comprising in combination a platform attached to a mother boat slightly above the water line, a cradle means attached to the free end of the platform in pivotal relationship so that the cradle can pivot towards and away from the water, sling means for attaching to the small craft, and power means for attaching to the sling for pulling the small craft into the cradle and securing the small craft to the mother boat.

This invention also relates to a method of raising, storing, and lowering a small craft to a mother boat comprising using the above mentioned small craft carrying device. The small craft is broad along side the mother boat with the cradle pivoted in the outward position towards the water, sling means is attached to the small craft and to the power source and the power source pulls the small craft transversely to its normal travel path into the cradle so that the cradle pivots in the direction towards the mother boat and out of the water, sling means is then affixed to the mother boat for storing the small craft thereto.

BRIEF DESCRIPTION OF THE INVENTION

DETAILED DESCRIPTION OF THE INVENTION

Figure 1:
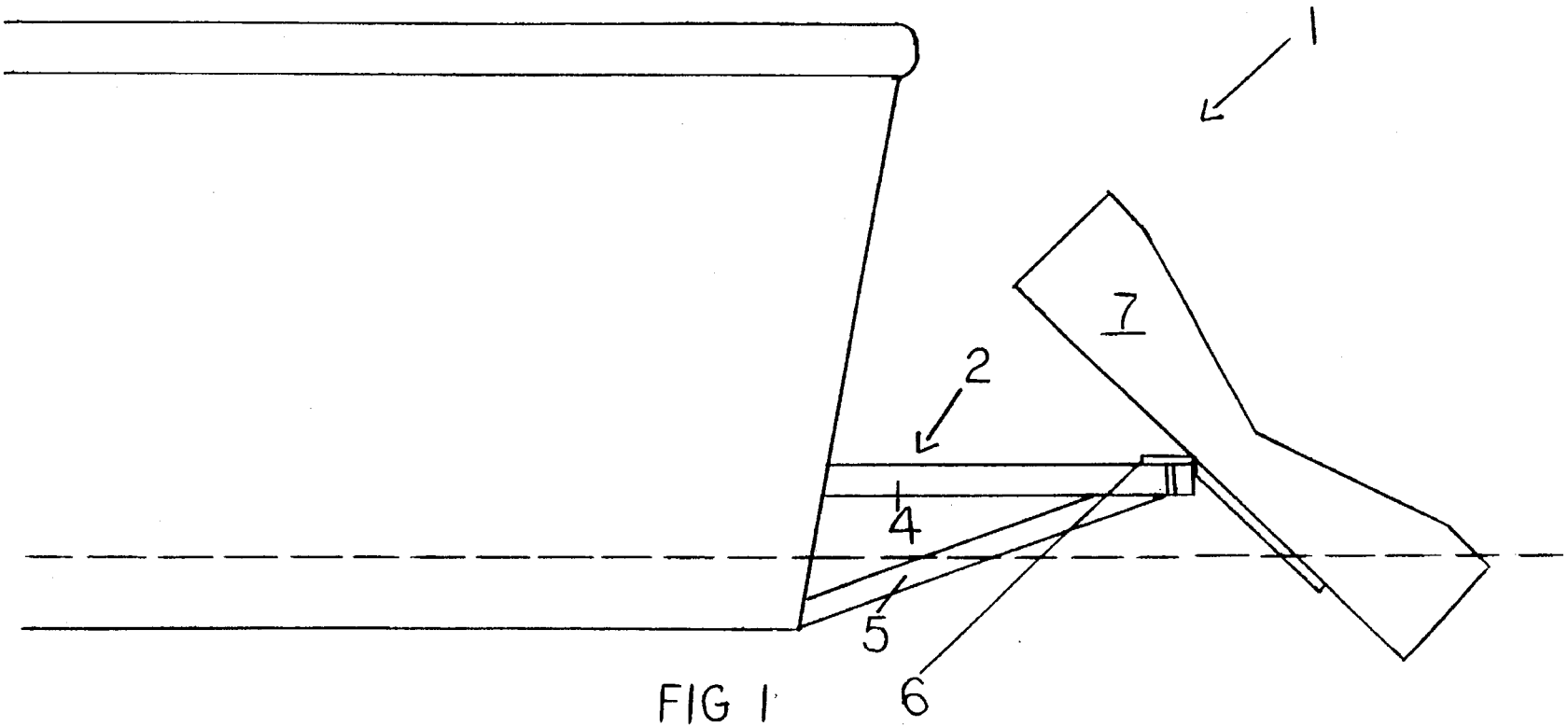
FIG. 1 is a side view of the rear (stern) area of a boat showing the small craft carrier device with the cradle in the outward position for loading a small craft.

Referring now to the drawings, this invention is a small craft carrier 1; although a jet ski is mentioned throughout this description, it should be understood that this device 1 can be used with any small craft that is to be carried by a mother boat, such as not only a jet ski but also a dinghy, small inboard or outboard boats, or any other small water vessel that is suitable for being carried by a mother boat. It should be understood that these small crafts should weigh approximately up to 600 pounds and be no longer in length than the width of the mother boat. The mother boat has to be of an adequate size and dimensions to handle the weight of a small craft. Generally, the mother boat has to be at least approximately 20 feet in length and has to have an inboard mounted engine with a swim platform on the rear.

This carrying device 1 comprises a platform 2 attached to a mother boat 20 slightly above the water line; this platform 2 can have any design that is suitable for withstanding the load of a small craft and simple for attaching to a mother boat. FIGS. 1–4 show a simple platform design of a horizontal member 4 attached to the mother boat at one end and at least two braces 5 for supporting the member 4; braces 5 also are attached to the other end of member 4. A hinge 6 is attached to the end of member 4 where braces 5 support member 4; bolts and nuts go through 4, 5, and 6 for securing cradle 7 to the platform 2.

Figure 2:
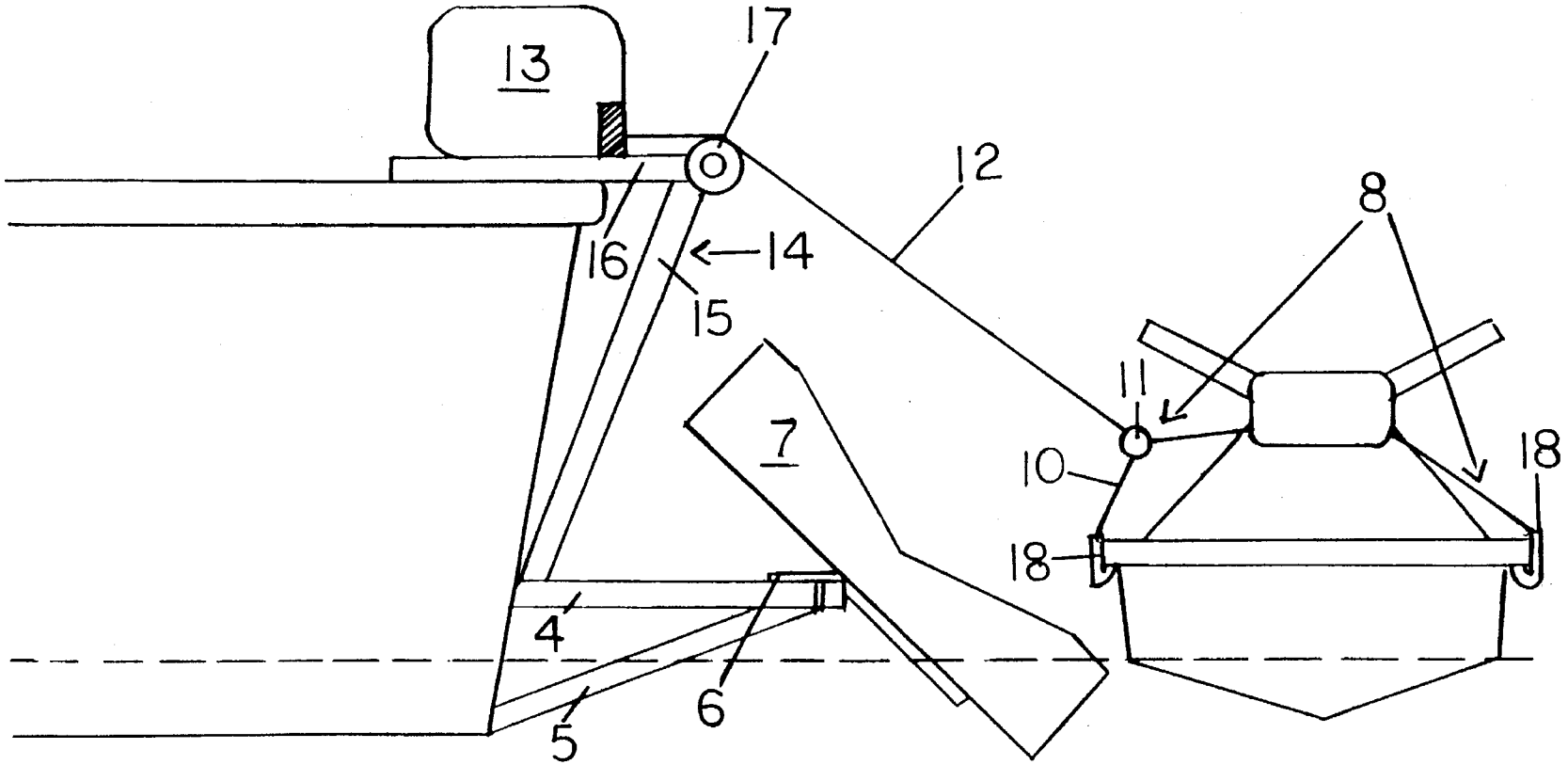
FIG. 2 is a side view of the rear (stern) area of a boat showing the small craft engaging the cradle of the carrier device for loading.
Figure 3:
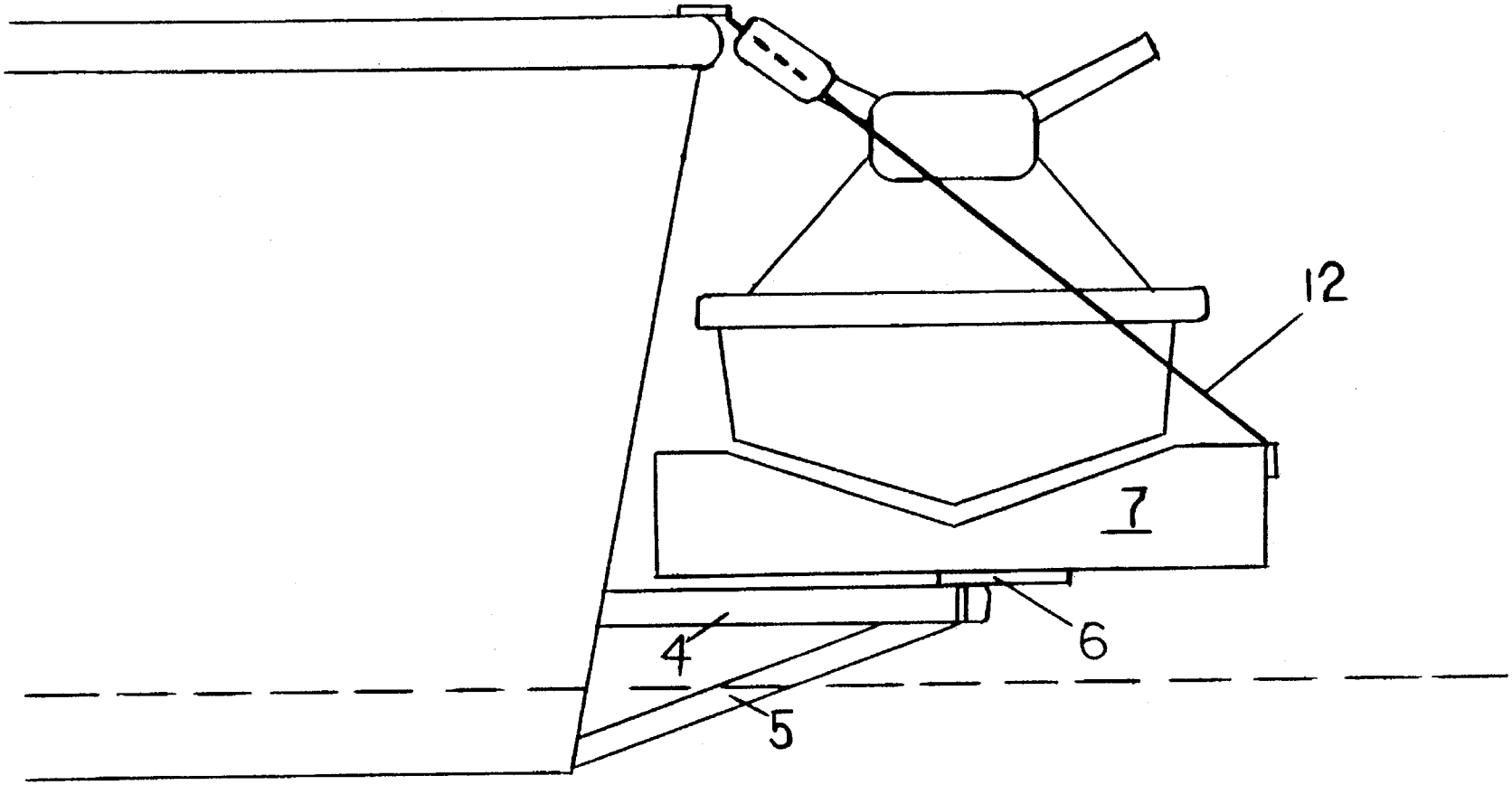
FIG. 3 is a side view of the rear (stern) area of a boat showing the small craft in the stored position.

Cradle means 7 is attached to the free end of the platform 2 in pivotal relationship via hinge 6 so that the cradle can pivot towards and away from the water; FIGS. 1 and 2 show the cradle 7 in the outward position for loading the craft thereon. This cradle means can have many designs such as from complicated designs where many elements are attached together with rollers located in a network of the plurality of elements that changes their shape to conform to the design of the bottom of the craft that is being carrier by pressure when being loaded to other simple pre-designed cradle shapes that are built to take the particular shape of the small craft that is to be carried. The cradle 7 shown in FIGS. 1–4 is the simple design that is built to take the shape of a particular craft. It should be understood that the cradle 7 design can be modified to conform to any hull design or configuration of any small craft.

Sling means 8 is for attaching and pulling the small craft onto the cradle 7. Sling means 8 can be as simple as a set of straps that fit around the bottom of the craft to a system of gunnel mount brackets 18 (FIG. 2) with a plurality of flexible straps 10 that are all connected to a grommet 11 at a central location above the brackets for distributing the work load; this grommet 11 then is attached to a line or cable 12 that is attached to a power pulling means 13.

Figure 4:
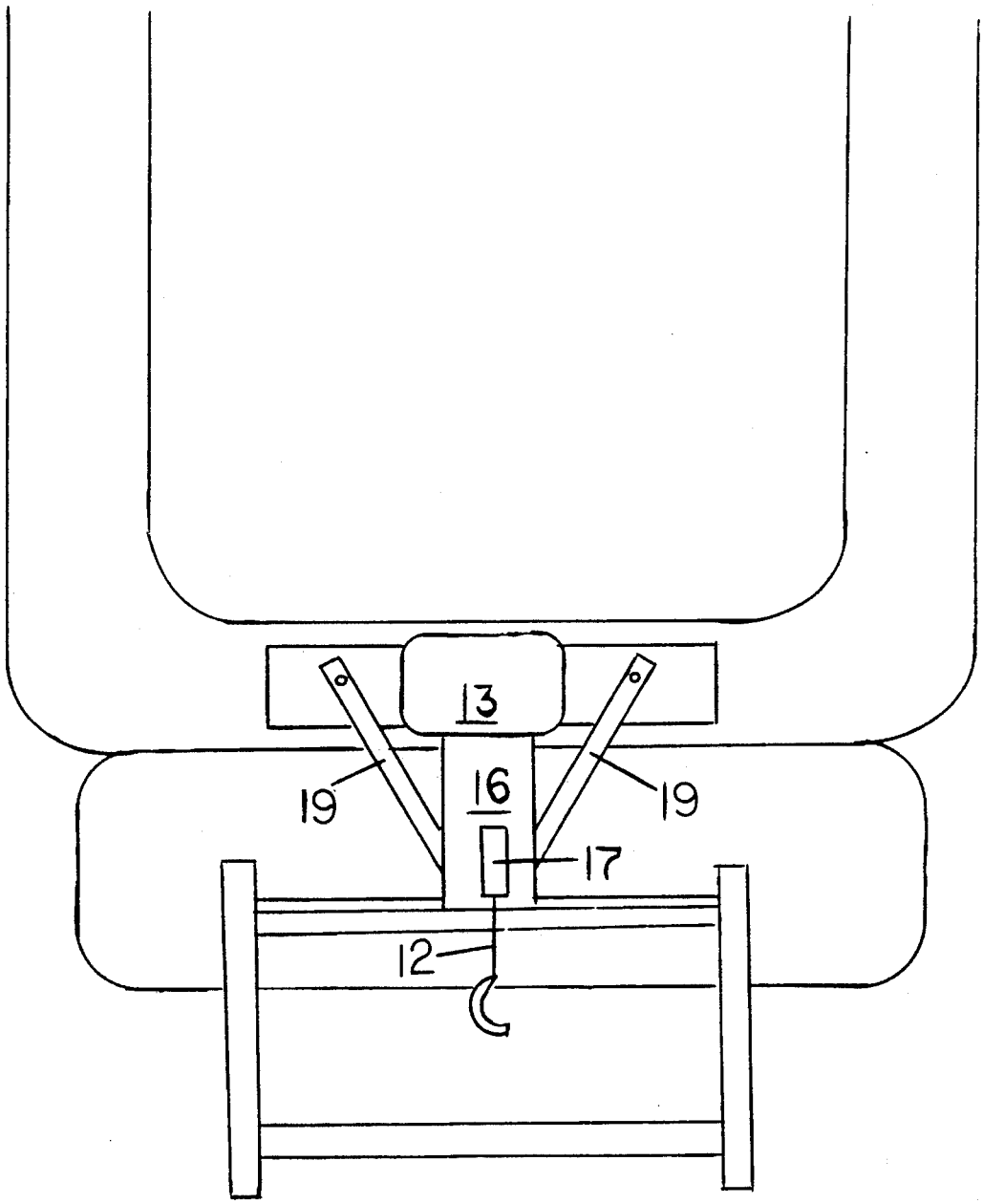
FIG. 4 is a top view of the carrying device.

The power pulling means 13 for attaching to the sling 8 for pulling the small craft into the cradle and securing the small craft to the mother boat can be as simple as a set of blocks and tackles for manually pulling the small craft onto the cradle to as complicated as a power winch (shown in FIGS. 2 and 4) or a hand cranked winch or any other device for pulling the craft onto the cradle. FIGS. 2 and 4 show a portable power winch and cable assembly that is attached to the stern of the boat with a portable boom assembly 14 with attachable support portions 15 and 16 and spindle 17 for cable to run over for guiding the cable in reduced frictional movement. Spindle 17 turns as it guide the cable to the power winch 13. Once the use of these portable boom and power winch assemblies are completed, they can be removed from the railing of the mother boat and stored.

Power for the motor to the winch is supplied by the battery (not illustrated) of the boat through a central control that regulates the motor. The motor control permits the operator to actuate the motor simultaneously or independently so as to provide proper lowering or raising the craft. In other words, this device is simple enough with the winch so that a single person can operate it safely.

The platform and cradle are normally made from plastic or wood or any other strong materials out of which boat parts are normally made such fiber glass; hinges, nuts and bolts, and metal portions of the sling can be made of any material that is strong enough to withstand the weight of the small craft as well as the conditions of the brackish water and weather. Hard plastic materials and metals such as anodized aluminum or chrome plated steel can be used to make these parts.

When the small craft is in the stored position, additional rachet straps 12 should be used to firmly hold the craft in place. After the winch and boom assemblies are removed, the rachet straps 12 are attached to the jet ski and cradle 7 in order to distribute the working load of the jet ski properly. The rachet straps 12 as well as the sling straps 8 can be made from nylon or any other similar materials having strength and durability to withstand the weight of the small craft and elements associated with the sea.

Figure 6:
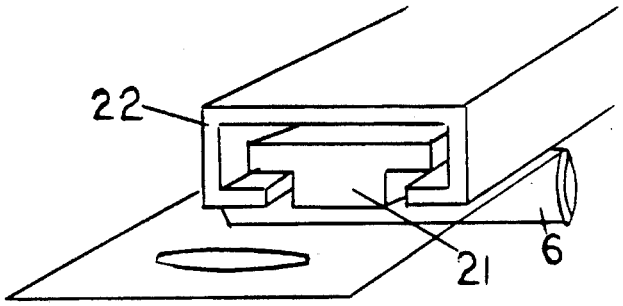
FIG. 6 is a cut-a-way view of FIG. 5 along lines 6—6 of the sliding plate track mechanism.
Figure 5:
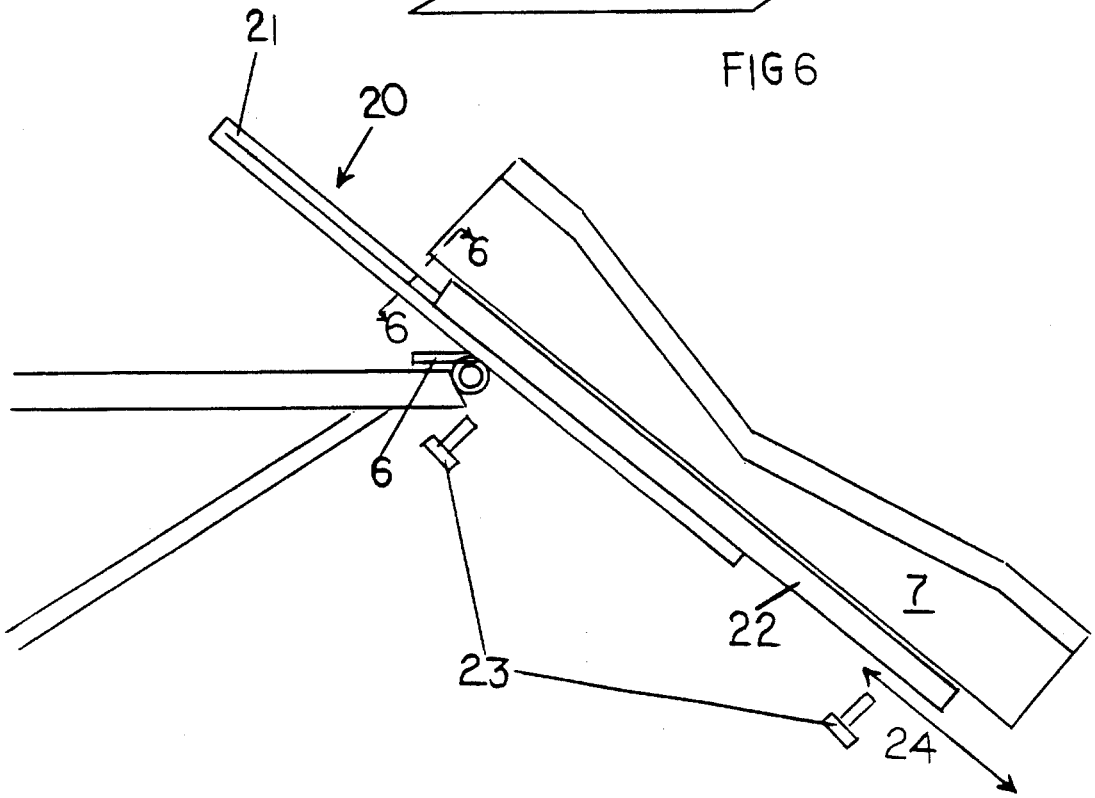
FIG. 5 is a side view of another embodiment of the tilting hinge using a sliding plate track mechanism of the present invention.

The above described design of the carrier 1 is the basic design; in another embodiment (FIGS. 5 and 6), the hinge 6 can be attached to a slide plate mechanism 20 that is attached to the bottom of the cradle. The slide plate mechanism has male 21 and female 22 portions where one portion is attached to the cradle by way of bolts 23 and the other portion is attached to the hinge 6 that is attached to the swim platform 2. In between the male 21 and female 22 portions are located a plurality of ball bearings (not illustrated) in which the male and female portions are in intimate contact for permitting one portion to move smoothly over the other in a fixed track in an upward and downward path as illustrated in FIG. 5 by arrow 24. This slide plate mechanism 20 permits the cradle 7 to be lowered below the water surface to facilitate easy loading of a small craft thereon. When the small craft is pulled towards the mother boat onto the cradle 7, the mechanism 20 allows for a more friction free travel of the cradle; the cradle first moves upward towards the mother boat in the path of the slide plate mechanism to its full retracted position before the cradle pivots to its final carrying position. The shifting of the center of inertia of the weight of the small craft is the force that shifts the cradle with the small craft thereon to its final carrying position higher above the water line than with the basic embodiment described above. By using this embodiment, the small craft is carried higher out of the water than when using the basic design. In other words, the swim platform can be installed higher above the water line for storing the small craft higher out of the water so that it will not be beat up by the sea in stormy weather or when traveling at sea with the small craft on board. In certain instances, this design is more desirable than the basic design.

Figure 7:
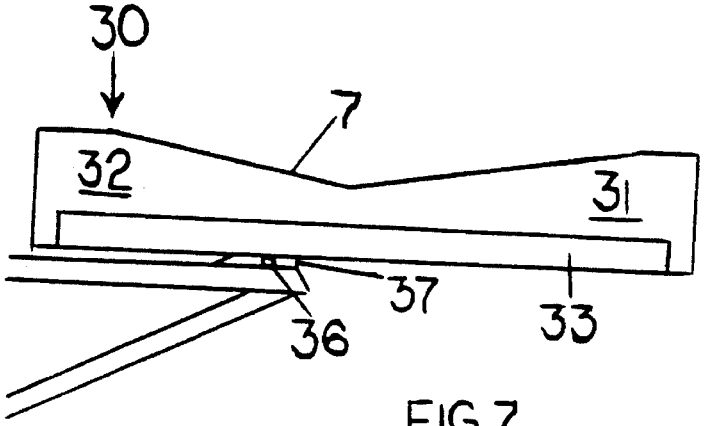
FIG. 7 is a side view of yet another embodiment of the tilting hinge using a sliding roller track mechanism where the cradle is in a horizontal position.
Figure 8:
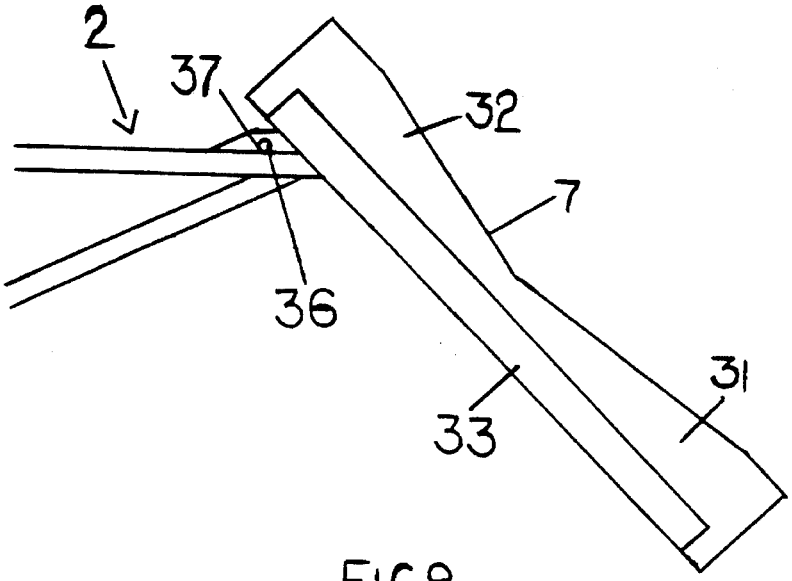
FIG. 8 is a side view of the embodiment of the tilting hinge using a sliding roller track mechanism where the crade is in a tilt position.
Figure 9:
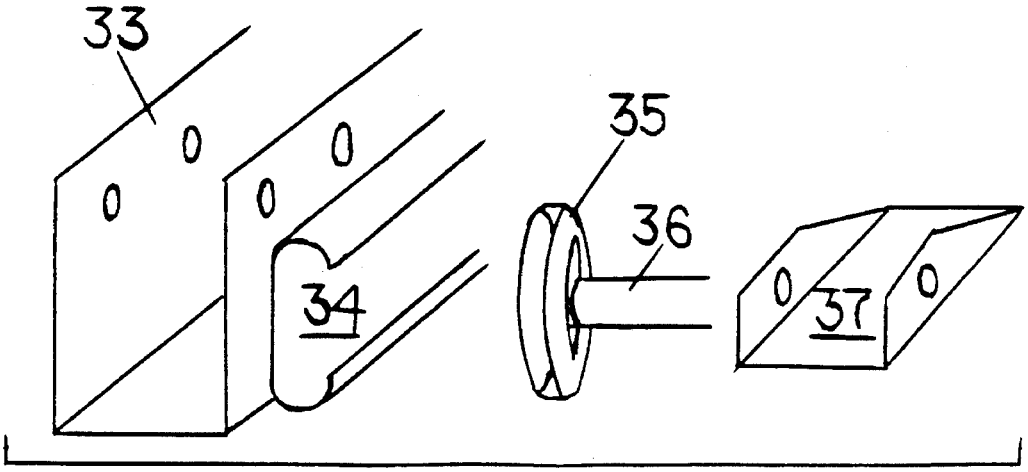
FIG. 9 is an exploded view of the sliding roller track mechanism of the embodiment of the present invention.
Figure 10:
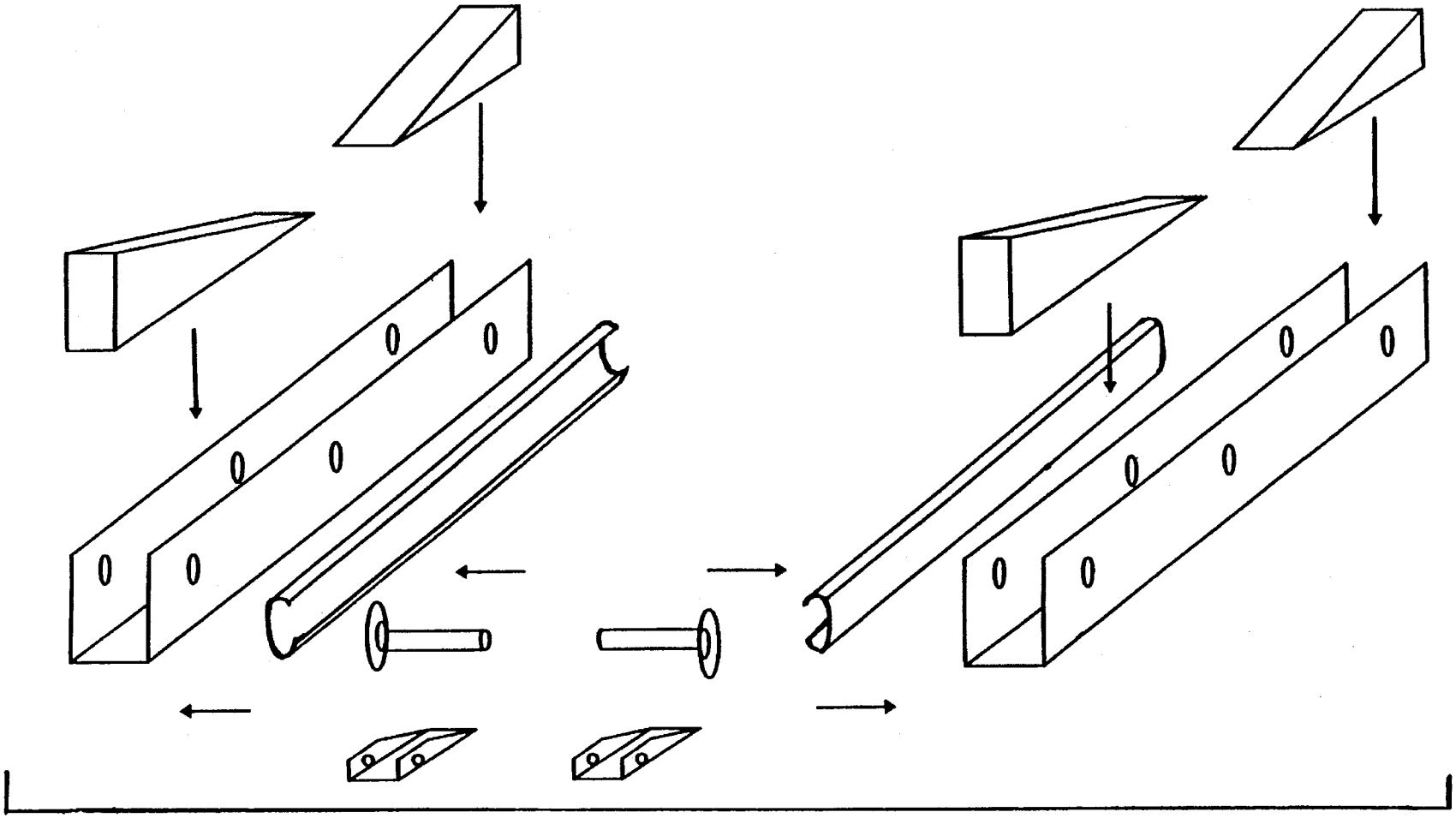
FIG. 10 is an exploded view of the carrier assembly with cradle of the sliding roller track embodiment of the present invention.

In yet another embodiment (FIGS. 7 to 10), the hinge 6 can be attached to a slide track mechanism 30 that is composed of a housing 33 in which the bottom of the cradle securely fits with screws or nails or any means capable of securely attaching the cradle to the housing 33. The slide track mechanism 30 has runner 34 in which a roller 35 travels. The roller 35 is attached to an axle 36 that fits into a carriage 37 that is secured to the swim platform 2. Inside of roller 35 are located a plurality of ball bearings (not illustrated) which permit the roller to move smoothly in the runner in a fixed path of the track in a horizontal and slanted path that moves the cradle in an upward and downward path as illustrated in FIGS. 7 and 8. This slide track mechanism 30 permits the cradle 7 to be lowered even farther below the water surface than in the other embodiments to facilitate easy loading of a small craft thereon.

In this embodiment, the cradle 7 has two components 31 and 32 that can be custom designed and exchanged to fit any particular bottom boat design. When a small craft is to be broad on board of a mother vessle, the slide track mechanism 30 is lowered into the water; because of the design of this mechansim 30, over half of the cradle 7 will be under the water making it easy to pull the small craft thereonto. When the small craft is pulled towards the mother boat onto the cradle 7, the mechanism 30 allows for a more friction free travel of the cradle; the cradle first moves upward towards the mother boat in the path of the slide track mechanism to its full retracted position before the cradle pivots to its final carrying position. The shifting of the center of inertia of the weight of the small craft is the force that shifts the cradle with the small craft thereon to its final carrying position higher above the water line than with the basic embodiment described above. By using this embodiment, the small craft is carried higher out of the water than when using the basic design. In other words, the swim platform can be installed higher above the water line for storing the small craft higher out of the water so that it will not be beat up by the sea in stormy weather or when traveling at sea with the small craft on board. In certain instances, this design is more desirable than the basic design.

It is appreciated that while particular embodiments of this invention have been shown and described, other modifications and changes can be made within the spirit and scope of the present invention. It is intended in the claims of this invention to cover all modifications which comes within the true spirit and scope of the invention.

What is claimed:

1. A small craft carrying device for securing to a platform attached to the stern and above the water line of a mother boat for raising, lowering, and storing a small craft onto the mother boat comprising a cradle means attached to the end of the platform in pivotal relationship so that the cradle means can tilt towards and away from the mother boat for transverse mounting of the small craft thereon, sling means comprised of a plurality of straps where one end of the straps are attached to gunnel mount brackets for attaching to the gunnel of the small craft and the other end of the straps are attached to a grommet at a central location above the brackets in adjustable relationship, and power means for attaching to the sling means for pulling the small craft transversely onto the cradle means and securing the small craft to the mother boat.

2. The small craft carrying device of claim 1, wherein the shape of the cradle means is the truncated v shape of the bottom of a jet ski.

3. The small craft carrying device of claim 2, wherein the cradle means is attached to the platform by a hinge.

4. The small craft carrying device of claim 3, wherein the hinge is attached directly to the cradle in tiltable relationship.

5. The small craft carrying device of claim 3, wherein the hinge is attached to a slide plate mechanism which is attached to the cradle in tiltable relationship.

6. The small craft carrying device of claim 3, wherein the hinge is attached to a slide track mechanism which is attached to the cradle in tiltable relationship.

7. The small craft carrying device of claim 1, wherein the power means is a portable power winch and cable assembly.

8. The small craft carrying device of claim 7, wherein the portable power winch and cable assembly is attached and operated with a portable boom assembly that is attached to the platform and deck of the mother boat.

9. A method of raising, lowering, and storing a small craft onto a mother boat comprising a) equipping the mother boat with a carrying device comprising a platform attached to the stern of the mother boat, attaching a cradle to the platform in tiltable relationship, sling means, and power means, b) bringing the small craft along side the stern of the mother boat with the cradle tilted in an outward position away from the mother boat, c) attaching the sling means to the small craft and to the power means, and d) activating the power means and pulling the small craft transversely to its normal travel path onto the cradle so that the cradle tilts in the direction towards the mother boat and out of the water.

10. The method of claim 9, wherein the small craft is secured to the mother boat with rachet straps for storing the small craft thereto.

11. The method of claim 9, wherein in step b the cradle is tilted away from the mother boat and slides along a sliding track mechanism into the water below the water line where the majority of the cradle is submerged in the water.

12. The method of claim 11, wherein in step d activating the power means and pulling the small craft transversely to its normal travel path onto the cradle so that the cradle first moves along a fixed retracting path towards the mother boat a short distance out of the water and then tilts in the direction towards the mother boat and out of the water.

* * * * *